US011408137B1

(12) United States Patent
Skarphol et al.

(10) Patent No.: US 11,408,137 B1
(45) Date of Patent: Aug. 9, 2022

(54) BOLLARD ANCHOR SYSTEM

(71) Applicants: Andrew M. Skarphol, Pelican Rapids, MN (US); Christopher M. Skarphol, Pelican Rapids, MN (US); Jonathan A. Qual, Lisbon, ND (US)

(72) Inventors: Andrew M. Skarphol, Pelican Rapids, MN (US); Christopher M. Skarphol, Pelican Rapids, MN (US); Jonathan A. Qual, Lisbon, ND (US)

( * ) Notice: Subject to any disclaimer, the term of this patent is extended or adjusted under 35 U.S.C. 154(b) by 0 days.

(21) Appl. No.: 17/474,910

(22) Filed: Sep. 14, 2021

(51) Int. Cl.

| | |
|---|---|
| ***E01F 9/685*** | (2016.01) |
| ***E02D 5/74*** | (2006.01) |
| ***E02D 5/80*** | (2006.01) |
| ***B63B 21/06*** | (2006.01) |

(52) U.S. Cl.
CPC ..... *E01F 9/685* (2016.02); *B63B 21/06* (2013.01); *E02D 5/801* (2013.01); *E02D 5/74* (2013.01); *E02D 5/80* (2013.01)

(58) Field of Classification Search
CPC . E02D 5/74; E02D 27/80; E02D 5/801; E01F 9/685; B63B 21/06
See application file for complete search history.

(56) References Cited

U.S. PATENT DOCUMENTS 3,311,333 A * 3/1967 Galloway ..... E04H 12/187 52/298
4,218,859 A * 8/1980 Sams ..... E04H 7/30 52/745.01
4,437,427 A 3/1984 Mampaeij
5,379,563 A * 1/1995 Tinsley ..... E02D 27/44 52/298
5,797,704 A * 8/1998 Collins ..... E02D 27/50 52/165
6,120,723 A * 9/2000 Butler ..... E04B 5/10 249/34
6,352,390 B1 * 3/2002 Jones ..... E02D 35/00 405/230
7,374,363 B2 5/2008 Bousson, Sr
7,618,217 B2 * 11/2009 Henderson ..... E02D 27/12 52/294
7,621,085 B2 * 11/2009 Commins ..... F16B 5/0266 411/536
7,805,895 B2 * 10/2010 Kristensen ..... F03D 13/22 52/297
8,197,156 B2 6/2012 Morgan
8,523,479 B2 9/2013 Adler
9,133,590 B2 9/2015 Ball
(Continued)

OTHER PUBLICATIONS https://www.uline.com/BL_1534/Safety-Bollards/; Uline Saftey Bollards Webpage; Received Aug. 20, 2020.
(Continued)

*Primary Examiner* — Phi D A
(74) *Attorney, Agent, or Firm* — Neustel Law Offices

(57) ABSTRACT

An anchor system for anchoring a bollard. Some of the various embodiments of the present disclosure include a base and a rod. The rod is inserted into the ground to secure the rod to the ground. The base is connected to the rod to secure the base to the ground. The bollard is connected to the base to secure the bollard to the ground. Some other embodiments include the base, the rod, and/or a helical member, a nut, a washer, one or more prongs, and one or more set screws.

17 Claims, 11 Drawing Sheets

(56) References Cited

U.S. PATENT DOCUMENTS

| | | | | |
|---|---|---|---|---|
| 9,388,547 | B2 | 7/2016 | Kellner | |
| 10,753,055 | B2 | 8/2020 | Tosolini | |
| 2004/0118058 | A1* | 6/2004 | Bigford | E04H 12/2246 52/170 |
| 2009/0028638 | A1 | 1/2009 | Crawford | |
| 2013/0255169 | A1* | 10/2013 | Henderson | E02D 27/42 52/223.13 |

OTHER PUBLICATIONS https://www.uline.com/Product/Detail/H-2121/Safety-Guards-Barriers/Concrete-Installation-Kit-for-Safety-Guards?keywords=bollard+anchors; Uline Concrete Installation Kit for Safety Guards Webpage; Received Aug. 20, 2020.

CAD Drawing provided by Applicant of Typical Bollard Plan Layout and Details—Bollar/Rail Plan and Details for Cumberland Dairy; Jun. 13, 2019.

* cited by examiner

BOLLARD ANCHOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

The described example embodiments in general relate to bollards for mooring or protecting property from impact.

Generally, installing a bollard in new construction requires drilling a hole in the ground, placing the bollard in the hole, bracing the bollard to keep it plumb, then pouring concrete around the bollard. Installing a bollard in existing concrete requires drilling a hole through the concrete and into the ground, placing the bollard in the hole, bracing the bollard to keep it plumb, then filling in around the bollard with concrete. Existing techniques provide little or no room for adjustment to the position of the bollard after the hole is drilled. Users and installers of bollards in new construction would benefit from an anchor that is position prior to pouring concrete but that allows some flexibility in adjusting the position of the bollard when attached to the anchor.

SUMMARY

Some of the various embodiments of the present disclosure relate to an anchor system for anchoring a bollard. Some of the various embodiments of the present disclosure include a base and a rod. The rod is inserted into the ground to secure the rod to the ground. The base is connected to the rod to secure the base to the ground. The bollard is connected to the base to secure the bollard to the ground. In some embodiments, the anchor includes the rod, the base and a helical member. The helical member is connected to the rod and facilitates boring the rod into the ground to secure the rod to the ground. In some other embodiments, the anchor includes the base, the rod, a nut and a washer. The nut and the washer are for securing the rod to the base to secure the base to the ground. In some other embodiments, the anchor includes the base, the rod and one or more set screws. The one or more set screws are for maintaining the position of the base relative to the rod after adjustment and/or leveling the base. The one or more set screws may further couple the base to the rod to secure the base to the ground. In some other embodiments, the base includes one or more prongs. The prongs are adapted to be surrounded by concrete to secure the base to the concrete.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

Figure 1:
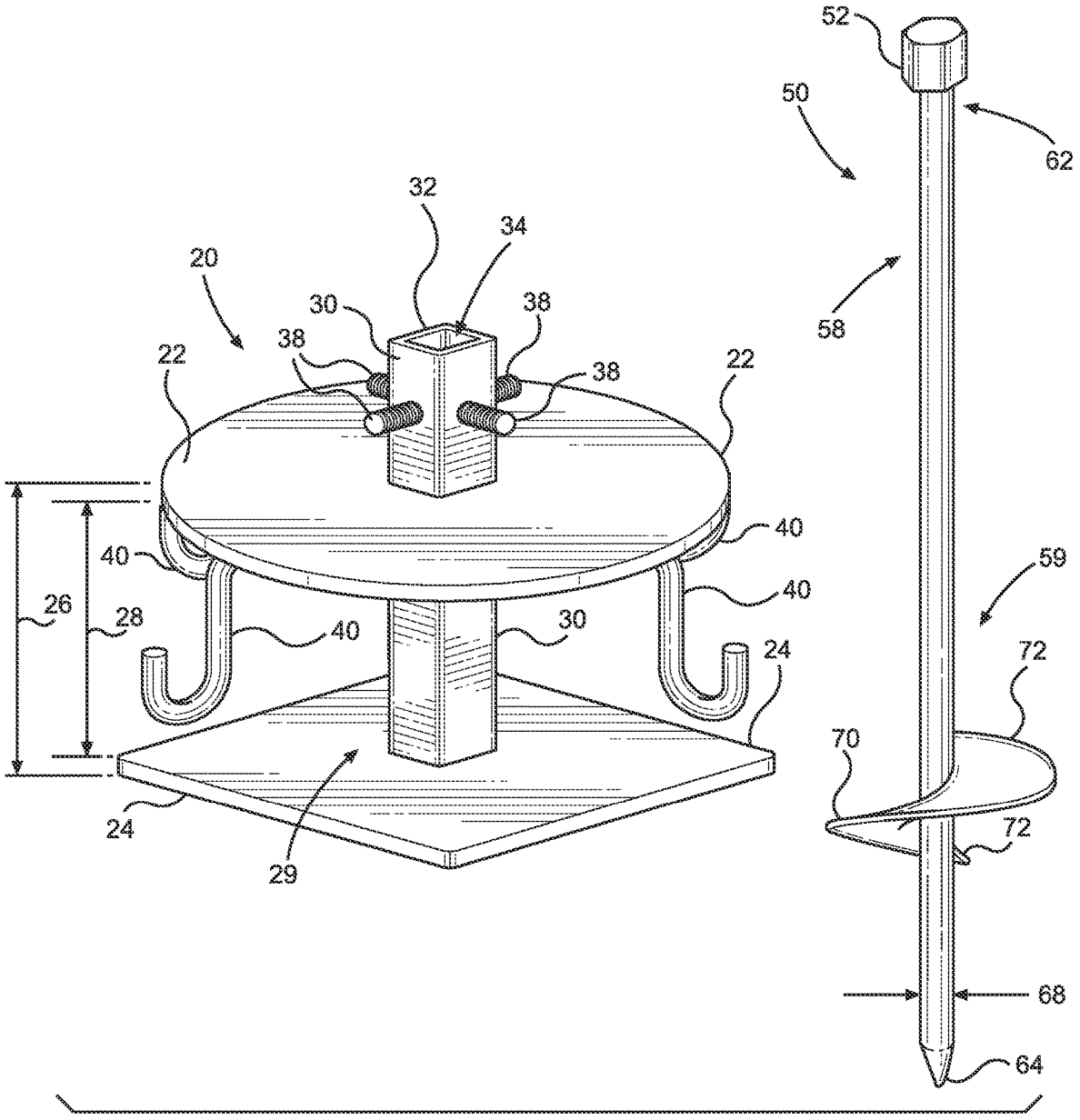
FIG. 1 is a perspective view of a base and a rod of an anchor system in accordance with an example embodiment.
Figure 2:
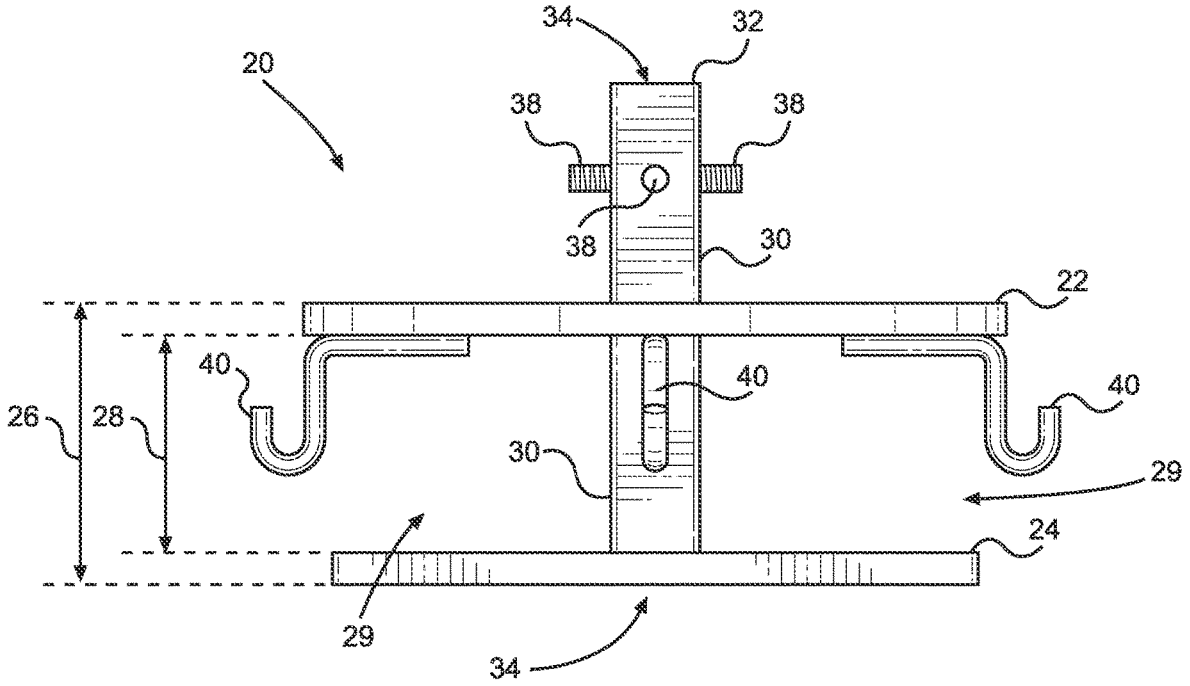
FIG. 2 is a first side view of the base from a first perspective.
Figure 3:
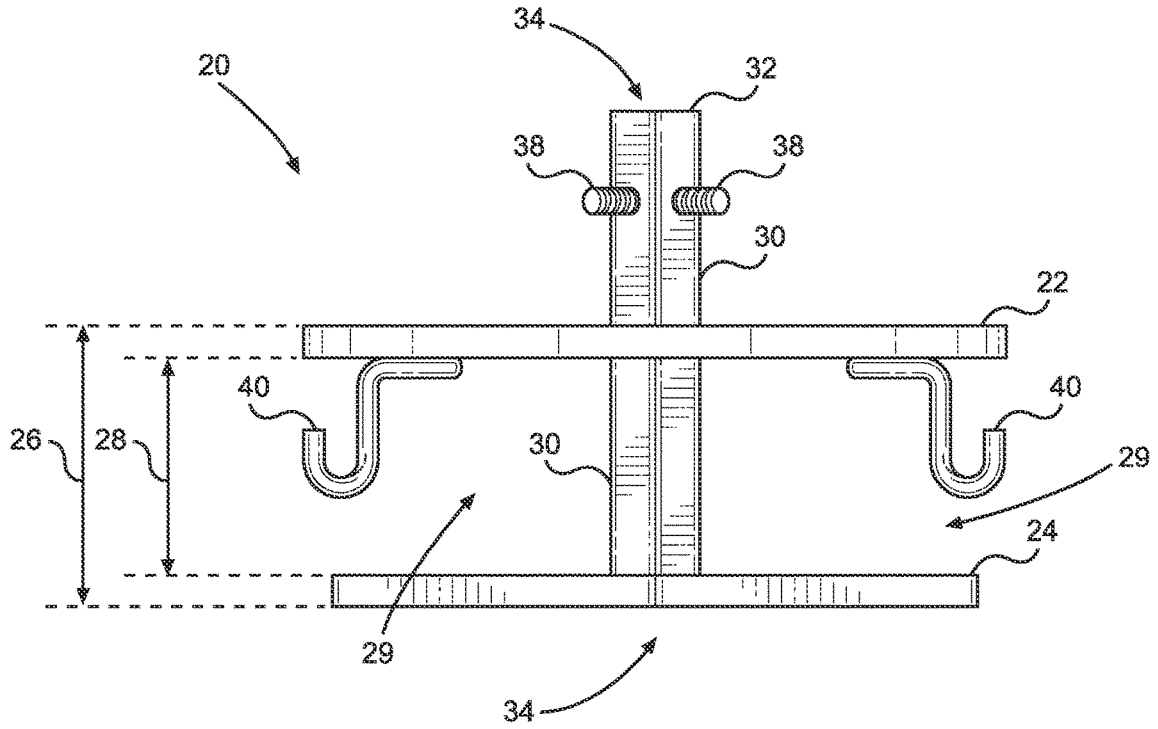
FIG. 3 is a second side view of the base from a second perspective.
Figure 4:
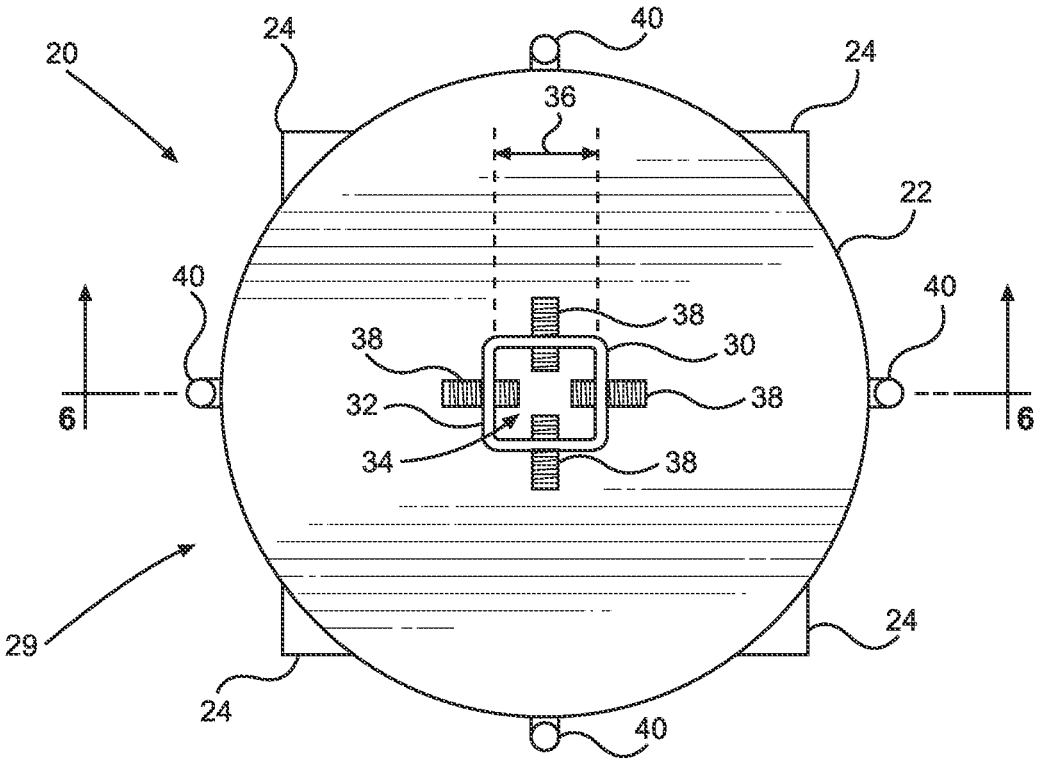
FIG. 4 is a top view of the base.
Figure 5:
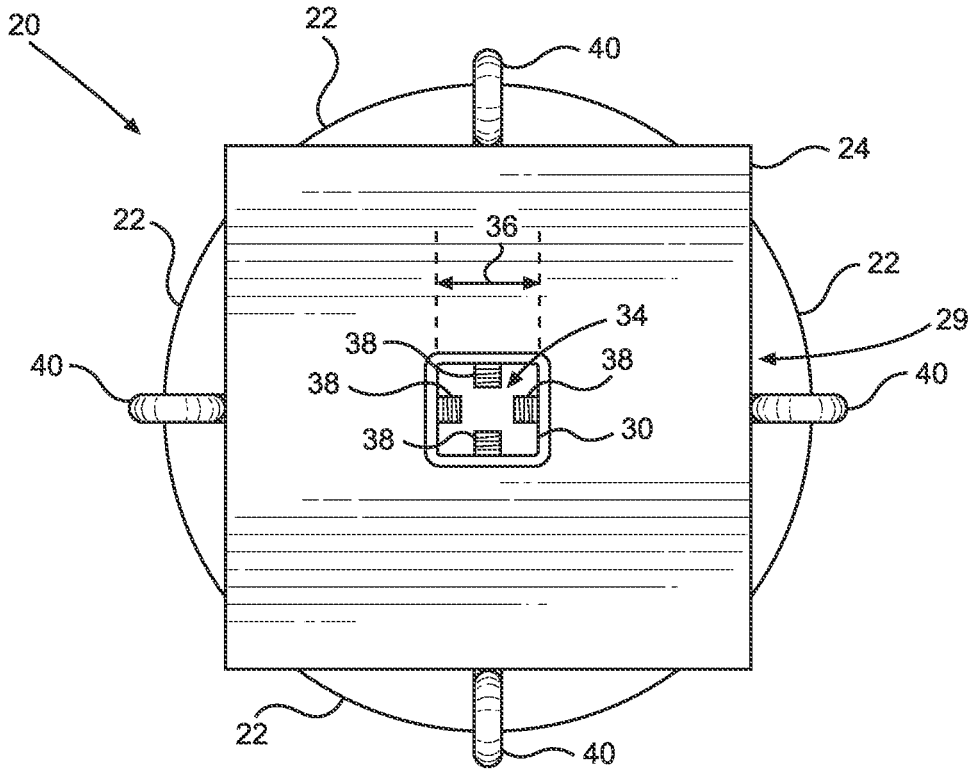
FIG. 5 is a is a bottom view of the base.
Figure 6:
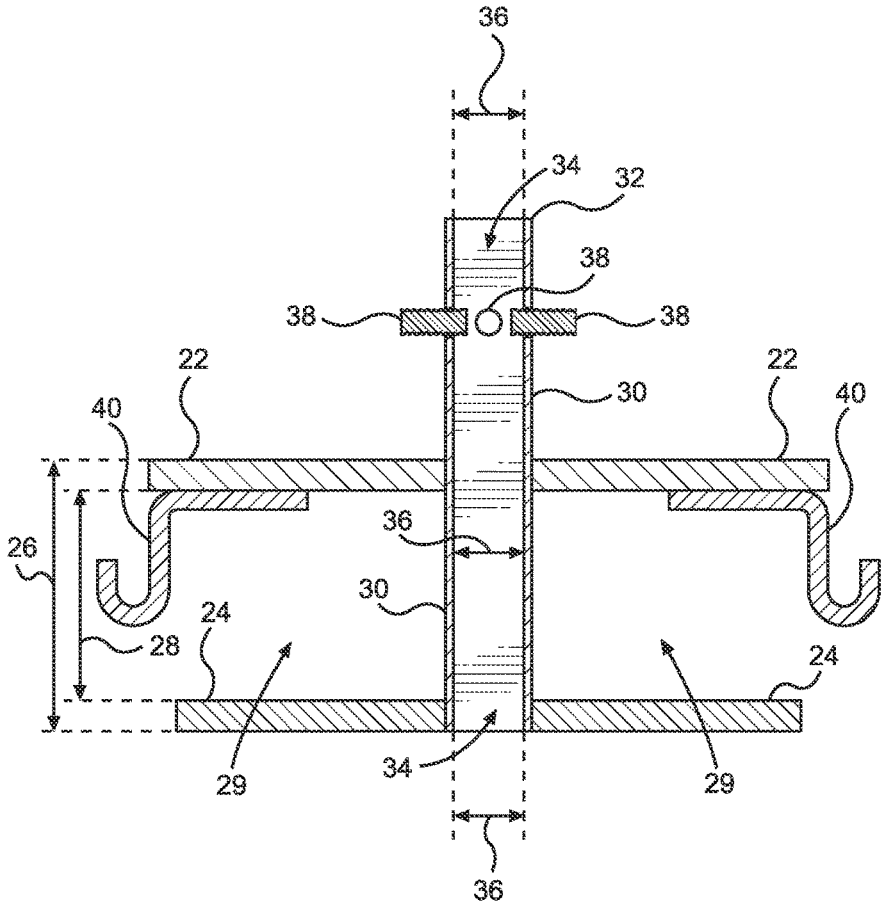
FIG. 6 is a is a cross-section of the base as shown in the top view in FIG. 4.
Figure 7:
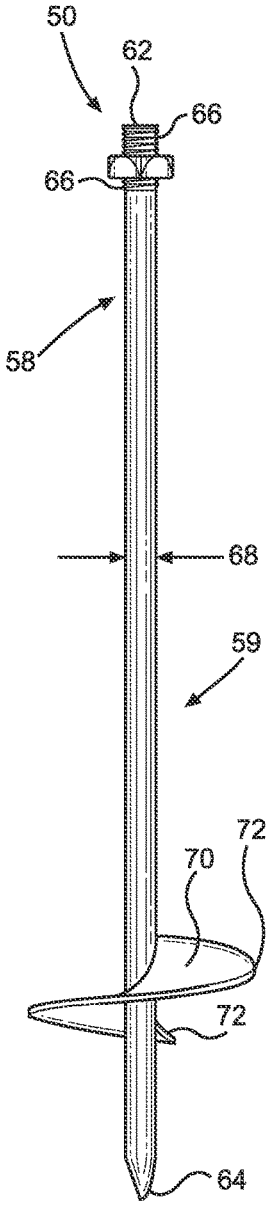
FIG. 7 is a side view of the rod.
Figure 8:
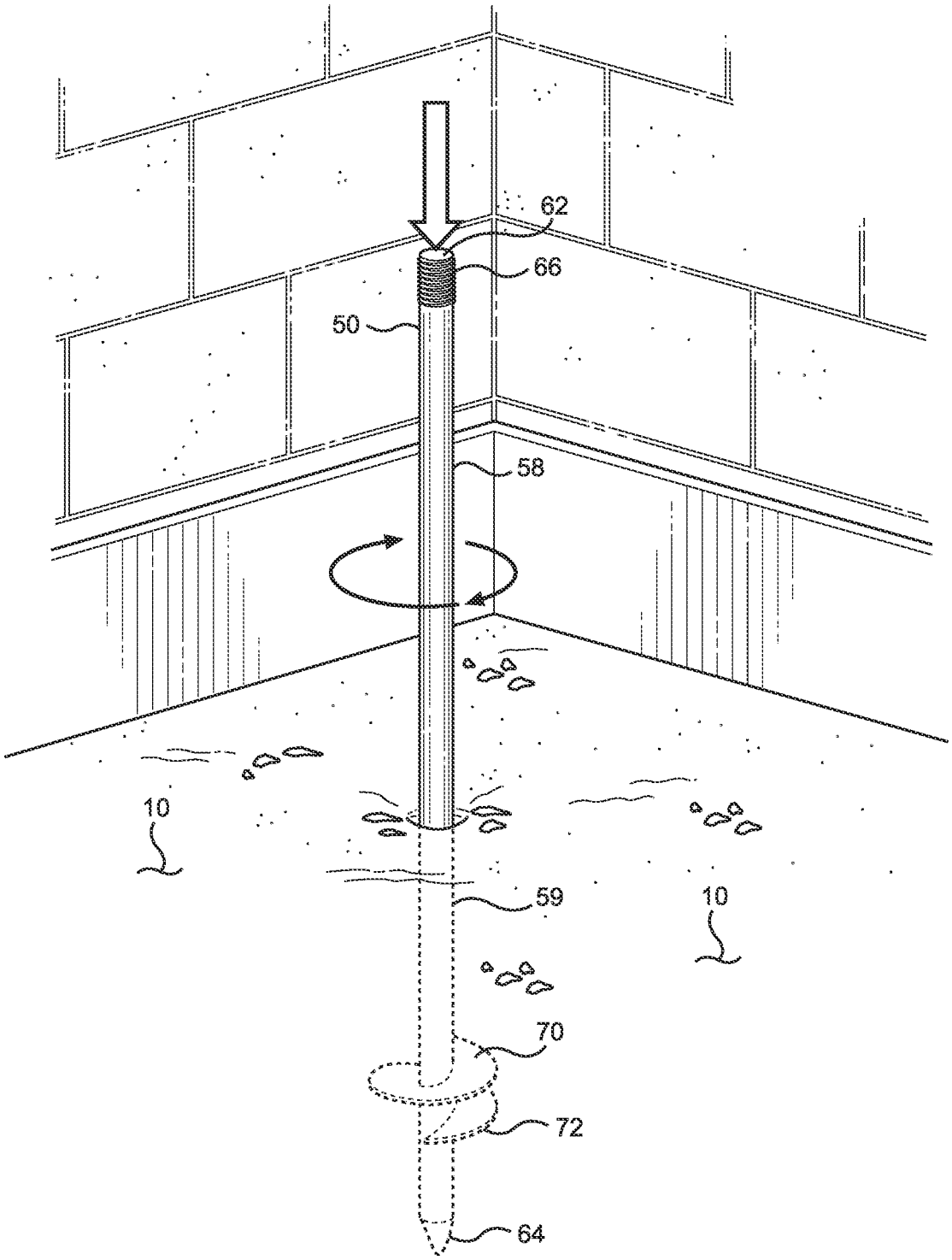
FIG. 8 is a perspective view of the rod inserted into the ground.
Figure 9:
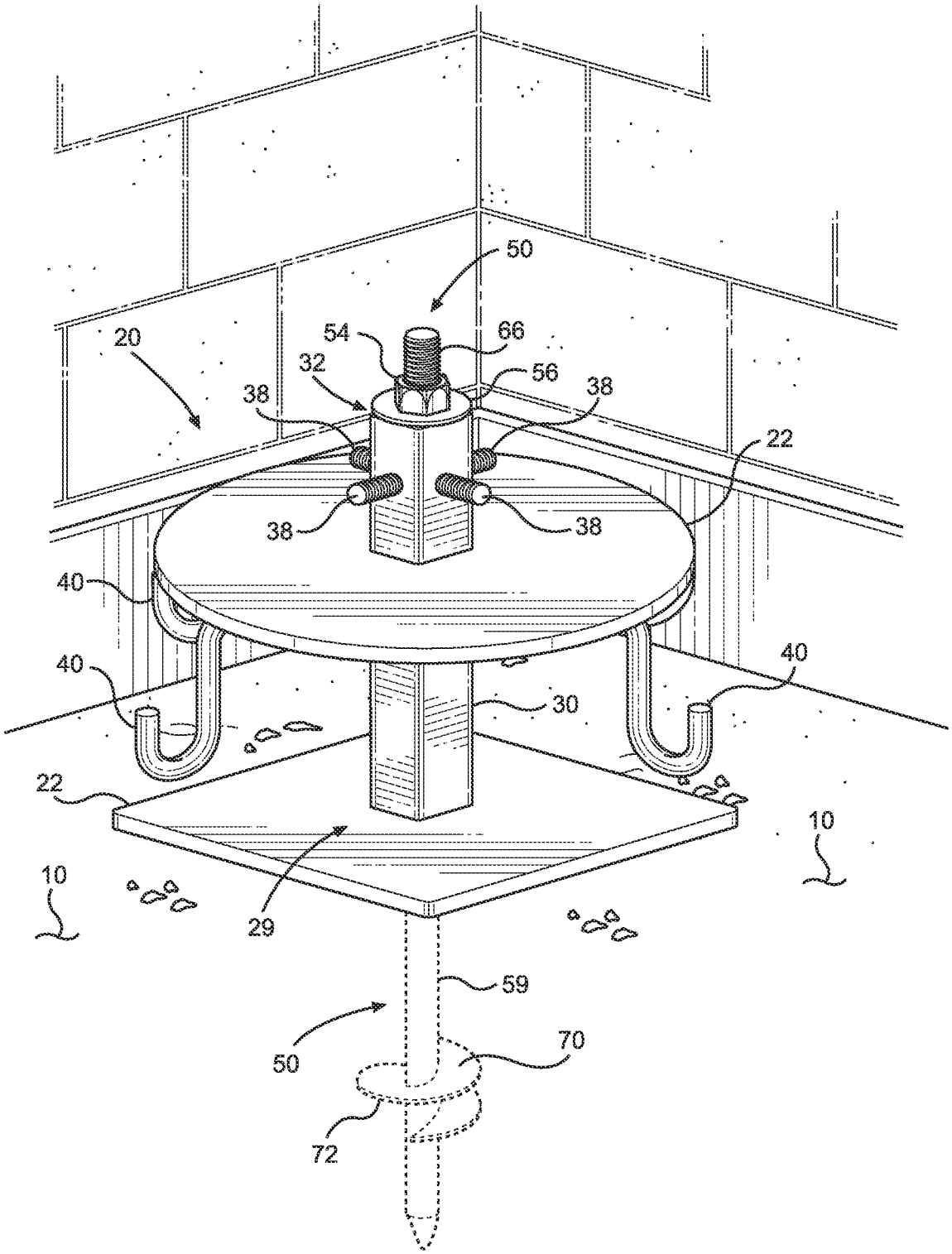
FIG. 9 is a is a perspective view of the base over the rod.
Figure 10:
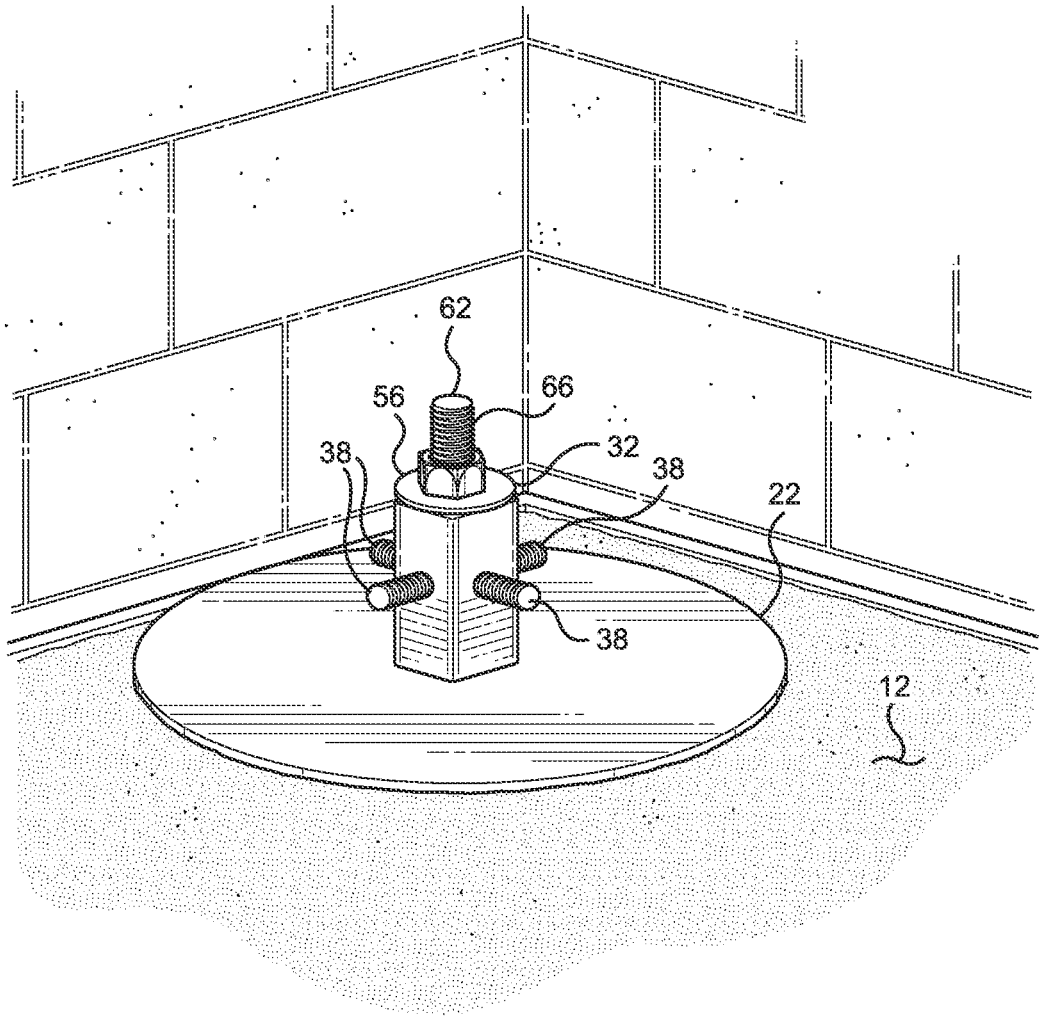
FIG. 10 is a perspective view of the anchor system after the concrete has been poured.
Figure 11:
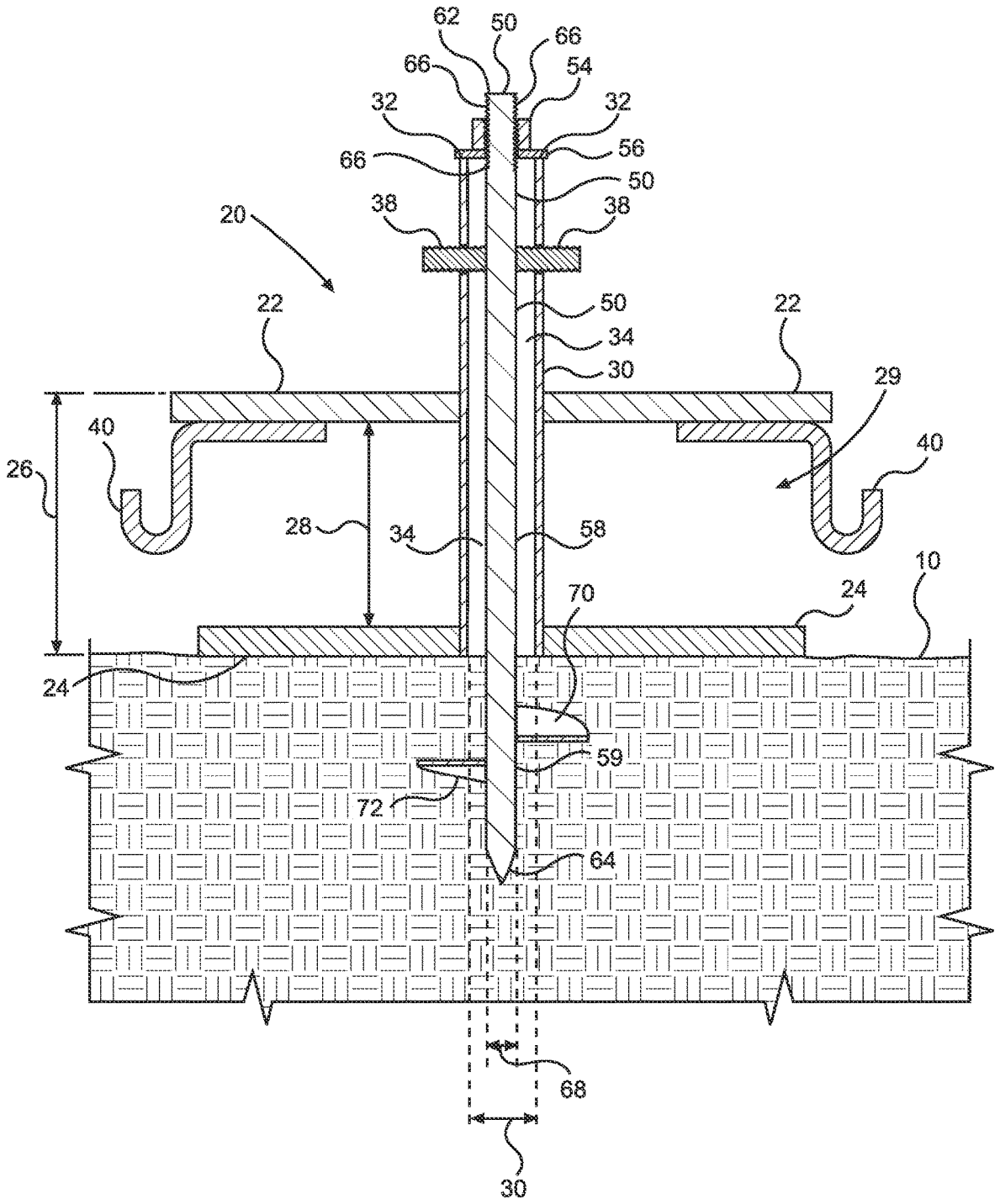
FIG. 11 is a cross-section of the anchor as shown in FIG. 9.

A. Overview.

Some of the various embodiments of the present disclosure relate to an anchor system that is adapted to anchor a bollard 14. The anchor system is further adapted to allow some adjustments to the position of the bollard 14 prior to and after pouring concrete 12 around the anchor. Some of the various embodiments of the present disclosure include a rod 50 and a base 20.

The rod 50, as best shown in FIGS. 1, 7-9 and 11-13, is adapted to be inserted (e.g., driven, forced) into the ground 10 to secure the rod 50 to the ground 10. The upper portion 58 of the rod 50 is positioned above ground 10 while a lower portion 59 of the rod 50 is positioned in the ground 10 to secure the rod 50 to the ground 10. The base 20 includes an upper support, a lower support and a tube having a channel therethrough. The upper support 22 and the lower support 24 are connected to a tube 30 and positioned a distance 28 apart from each other thereby leaving a space 29 between the upper support 22 and the lower support 24.

After the rod 50 is inserted into the ground 10, as best shown in FIGS. 8-9 and 11-13, the base 20 is adapted to be raised over the upper end 62 of the rod 50 and lowered so that the upper portion 58 of the rod 50 enters the channel 34 of the tube 30 thereby positioning the rod 50 in the tube 30. The base 20 is lowered until the lower support 24 of the base 20 touches the ground 10 whereby the upper end 62 of the rod 50 is adapted to stick out of the upper end 32 of the tube 30. The base 20 and the rod 50 are adapted to connect to each other thereby securing the base 20 to the rod 50 and thereby to the ground 10.

Figure 12:
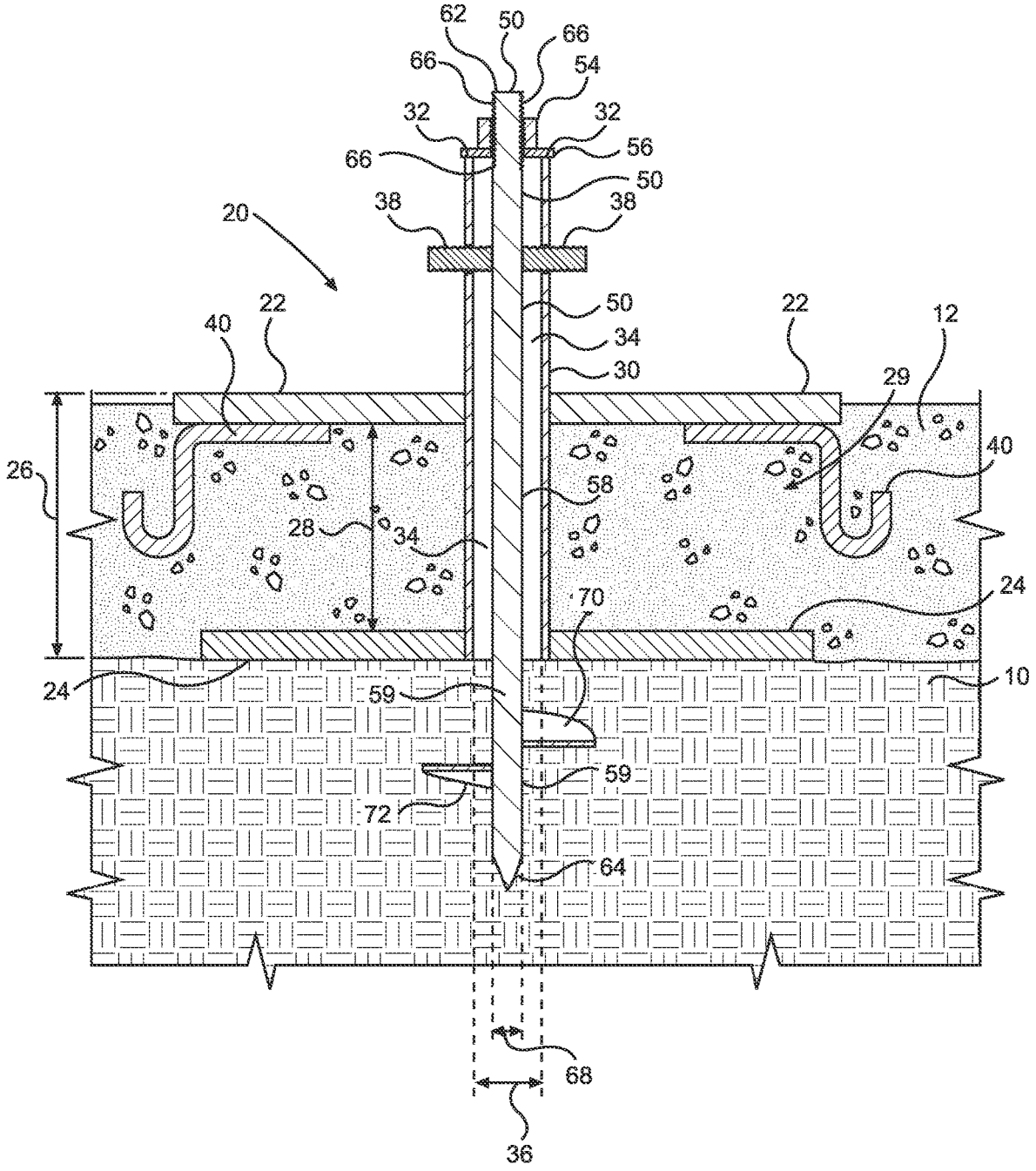
FIG. 12 is a cross-section of a first embodiment of connecting the rod to the base.
Figure 13:
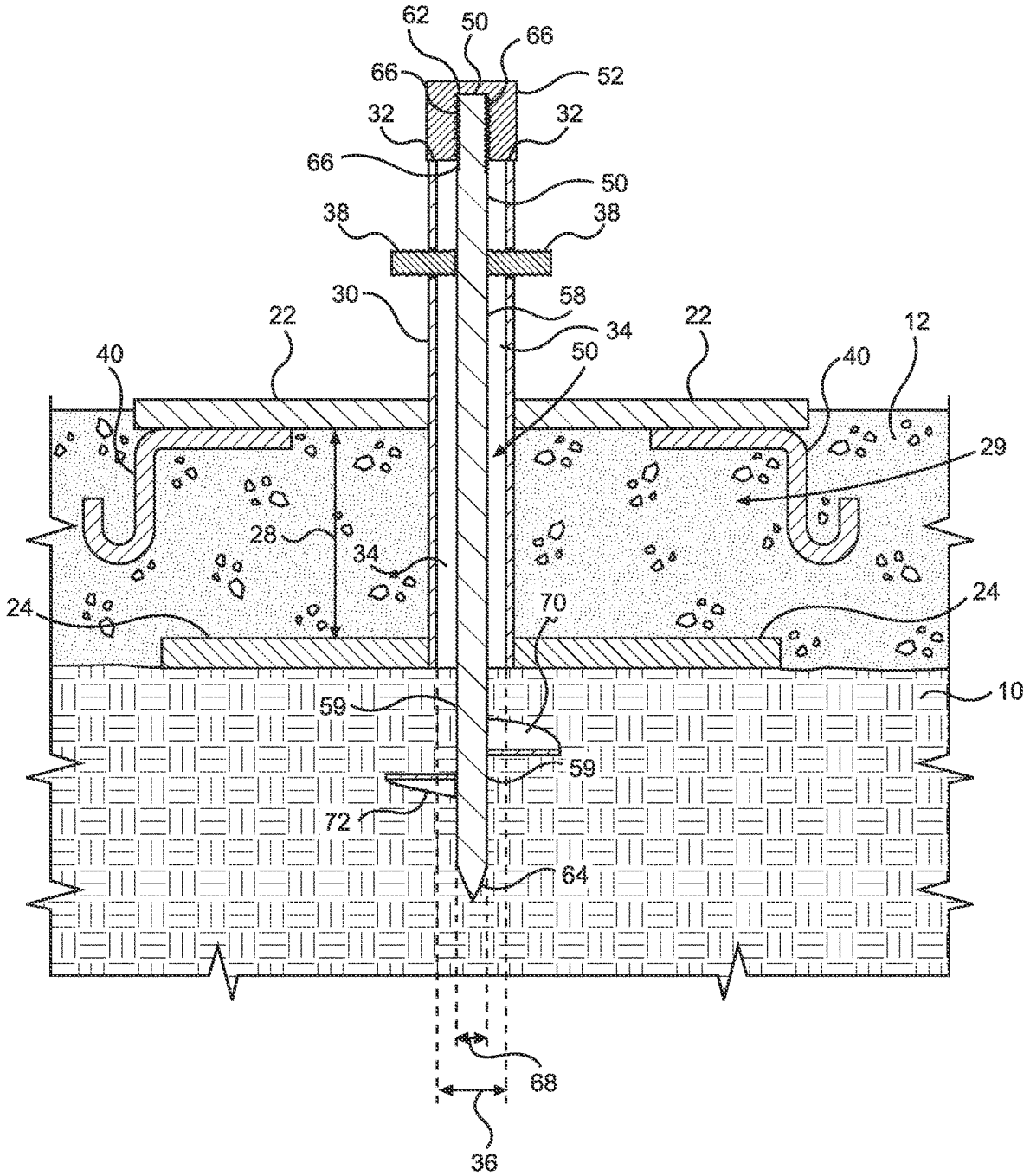
FIG. 13 is a cross-section of a second embodiment of connecting the rod to the base.
Figure 14:
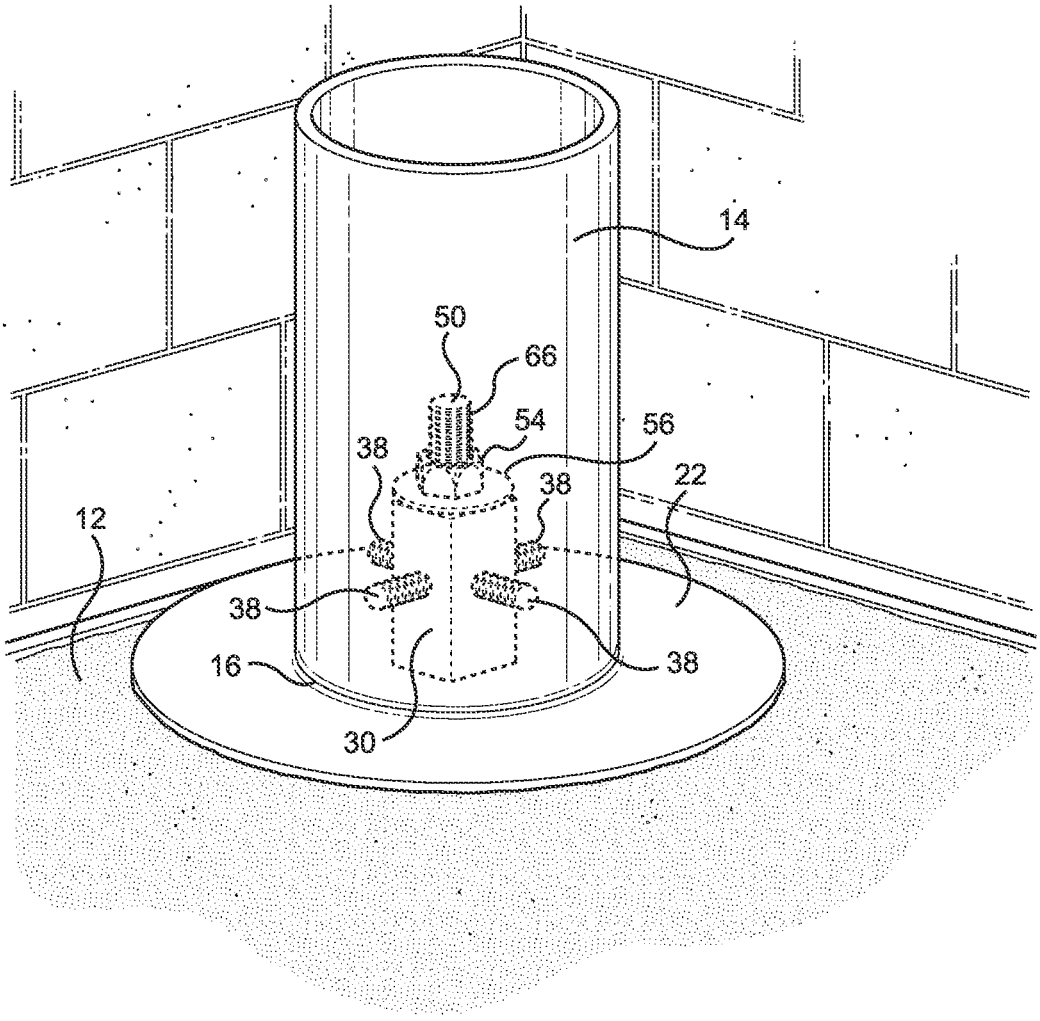
FIG. 14 is a perspective view of the bollard attached to the anchor system.

In some example embodiments, as best shown in FIGS. 9-14, the rod 50 is adapted to connect to the base 20 by placing a washer 56 around the rod 50 so that the washer 56 rests on the upper end 32 of the tube 30. A nut 54 is threadably connecting to the upper end 62 of the rod 50 and tightened until the nut 54 applies a downward force on the washer 56 and the tube 30 to secure the base 20 to the rod 50 and to the ground 10. In another example embodiment, set screws 38 are adapted to be positioned in holes in the sides of the tube 30. The set screws 38 enter the channel 34 to contact the upper portion 58 of the rod 50 thereby securing the tube 30 to the rod 50 and the base 20 to the ground 10 through the rod 50. In an example embodiment, the set screws 38 are adapted to position the base 20 with respect to the rod 50. In another example embodiment, as best shown in FIG. 12, the set screws 38 are adapted to level the base 20 with respect to the ground 10.

Once the rod 50 and the base 20 are secured to the ground 10, concrete 12 is poured around the base 20 and into the space 29 between the upper support 22 and the lower support 24 of the base 20. The concrete 12 hardens to further hold the base 20 in place. The upper surface of the upper support 22 of the base 20 is level with or positioned out of the upper surface of the concrete 12. The bollard 14 is positioned on the upper surface of the upper support 22 and connected to the upper support 22. Since the area of the upper support 22 is greater than the cross-section diameter of the bollard 14, the position of the bollard 14 may be adjusted with respect to the upper support 22 to better position the bollard 14 with respect to its surroundings.

Another example embodiment, as best shown in FIGS. 1-6, 9 and 11-13 includes prongs 40. Prongs 40 are adapted to connect to the base 20. Generally, the prongs 40 are positioned below the upper surface of the upper support 22 and above the lower surface of the lower support 24. The prongs 40 may be positioned, at least partially, in the space 29 between the upper support 22 and the lower support 24. The prongs 40 are adapted to be surrounded by the concrete 12, so the when the concrete 12 hardens, the prongs 40 further secure the base 20 to the concrete 12.

In another example embodiment, as best seen in FIGS. 1, 7-9 and 11-13, the rod 50 includes a helical member 70 for boring the rod 50 into the ground 10 to connect the rod 50 to the ground 10. The rod 50 may further include a grip 52 adapted to facilitate rotating the rod 50 to insert the rod 50 into the ground 10.

B. Rod.

The anchor system of the present disclosure includes a rod 50. The rod 50 (e.g., slender bar, staff, stick) may be inserted (e.g., pushed, driven, bored) into the ground 10. Inserting the rod 50 into the ground 10 secures the rod 50 to the ground 10. An object (e.g., base 20) may be secured to the ground 10 by connecting the object to the rod 50 that is secured to the ground 10.

In an embodiment, a rod 50 includes an upper portion 58, the lower portion 59, an upper end 62 and a lower end 64. The rod 50 is adapted to be partially inserted into a ground 10 thereby positioning the upper portion 58 of the rod 50 above the ground 10 and the lower portion 59 of the rod 50 in the ground 10. The lower portion of the rod 50 is adapted to secure the rod 50 to the ground 10. The lower portion 59 of the rod 50 is adapted to secure the rod 50 to the ground 10 through friction or interference between the ground 10 and the lower portion 59 of the rod 50. The lower portion 59 of the rod 50 may include structures (e.g., barbs, helical member) for increasing interference between the ground 10 and the lower portion 59 of the rod 50 to better secure the rod 50 in the ground 10.

The rod 50 may be formed of any material. Preferably, the rod 50 is formed of an inflexible and strong material capable of providing vertical and/or horizontal support while the rod 50 is secured in the ground 10. In an embodiment, the rod is formed of metal. The rod 50, formed of metal and inserted into the ground 10, is secured to the ground 10 and substantially immobile both vertically and horizontally. An object connected to the rod does not move in the vertical direction or the horizontal direction.

In an example embodiment, the rod 50 is a solid, metal rod having an outside diameter in the range of one-half inch to one and a half inches, preferably ⅝ inches. In an example embodiment, a length of the rod 50 is in the range of 18 inches to 42 inches, preferably 24 inches. In an example embodiment, the lower portion 59 of the rod 50 that is positioned in the ground 10 is between ¼ and ¾, preferably ⅓, of the length of the rod 50.

In an embodiment, as discussed further herein, the rod 50 may be rotated to insert (e.g., bore) the rod 50 into the ground 10. The rod 50 includes a grip 52 connected to or integrated into the rod 50 at or near an upper end 62 of the rod 50. The grip 52 is adapted to facilitate rotating the rod 50 to bore the lower portion 59 of the rod 50 into the ground 10. A grip 52 may include two or more flat sides (e.g., facets). The grip 52 may include six flat sides that form a hexagon. The two or more flat sides facilitate removably coupling a tool (e.g., wrench, socket, drill) to the grip 52 to rotate the rod 50. The grip 52 may be separate from the rod 50 and removably coupled to the rod 50.

In an example embodiment, the grip 52 comprises a nut 54 threadably connected to the rod 50 at or near the upper end 62 of the rod 50. In an example embodiment, the nut 54 is adapted to threadably connect to the rod 50 at or near the upper end 62 of the rod 50. In an example embodiment, the nut 54 has a hexagonal shape of a conventional nut. The nut 54 is threadably connected to threads on the upper end 62 of the rod 50. The threads are formed along only a portion of the upper portion 58 of the rod 50. The nut 54 is threadably connected to the threads and rotated clockwise until the nut 54 reaches the ends of the threads. While positioned at the end of the threads, the nut 54 can no longer be rotated clockwise without rotating the rod 50, so the rod 50 may be rotated for inserting the rod 50 into the ground 10 by attaching a tool to the nut 54 and rotating clockwise.

In an example embodiment, after the nut 54 has been used to rotate the rod 50 to insert the rod 50 into the ground 10, the nut 54 may be rotated counterclockwise to remove the nut 54 from the upper end 62 of the rod 50. As discussed in further detail herein, the nut 54 is further adapted to connect the rod 50 to the tube 30 of the base 20 to secure the rod 50 to the base 20. After the base 20 has been lowered over the upper portion 58 of the rod 50, the nut 54 may be threadably reconnected to the upper end 62 of the rod 50 to connect the rod 50 to the tube 30.

In an example embodiment, the anchor system of the present disclosure comprises the nut 54. The nut 54 is adapted to threadably connect to the rod 50 at or near the upper end 62 of the rod 50 to connect the rod 50 to the tube 30 thereby securing the base 20 to the ground 10. The anchor system of the present disclosure may further include the washer 56. The washer 56 is adapted to be positioned around the rod 50 between an upper end 32 of the tube 30 and the nut 54, wherein the nut 54 applies a downward force on the upper end 32 of the tube 30 via the washer 56 to connect the rod 50 to the tube 30. The downward force connects the base 20 to the rod 50 thereby securing the base 20 to the ground 10.

The lower end 64 of the rod 50 may be adapted to facilitate inserting the rod 50 into the ground 10. In an example embodiment, the lower end 64 is pointed (e.g., tapered) to facilitate inserting the rod 50 into the ground 10.

The upper end 62 of the rod 50 may be adapted to receive a force to insert (e.g., drive) the rod 50 into the ground 10. In an example embodiment, the upper end 62 of the rod 50 is suitable for being struck by a tool (e.g., hammer) to drive the rod 50 into the ground 10.

C. Helical Member.

The anchor system of the present disclosure may further include a helical member 70 (e.g., twist, spiral). In an example embodiment, the helical member 70 is connected to the rod 50 at or near the lower end 64 of the rod 50. The helical member 70 is adapted to bore into the ground 10 responsive to rotating the rod 50 to position the lower portion 59 of the rod 50 in the ground 10. In addition to boring into the ground 10, the helical member 70 is further adapted to secure the rod 50 to the ground 10. The helical member 70 is further adapted to secure the rod 50 to the ground 10 because helical member 70 is a structure that increases interference between the ground 10 in the lower portion 59 of the rod 50 as discussed above.

In an example embodiment, the helical member 70 is connected to the rod 50 at or near the lower end 64 of the rod 50. The helical member 70 is adapted to bore into the ground 10 responsive to rotating the rod 50 to position the lower portion 59 of the rod 50 in the ground 10 and the upper portion 58 of the rod 50 above the ground 10.

In an example embodiment, the helical member 70 includes a cutting edge 72. The cutting edge 72 is positioned on a leading-edge of the helical member 70 as the helical member 70 is rotated. The cutting edge 72 is adapted to cut through (e.g., part) the ground 10 to facilitate boring into the ground 10.

The helical member 70 may be formed of any material suitable for boring. In an example embodiment, the helical member 70 is formed of metal and is welded to the rod 50 near the lower end 64 of the rod 50. The helical member 70 may be adapted to bore into the ground 10 while the rod 50 is rotated in a first direction (e.g., clockwise) and to facilitate exiting the ground 10 while the rod 50 is rotated in a second direction opposite to the first direction (e.g., counterclockwise).

D. Base.

The anchor system of the present disclosure includes a base 20. In an example embodiment, the base 20 includes an upper support 22, a lower support 24, and a tube 30 having a channel 34 therethrough. The upper support 22 and the lower support 24 are connected to the tube 30 and positioned the distance 28 apart from each other leaving a space 29 therebetween. In an example embodiment, the tube 30 is positioned through a hole of the upper support 22 and through a hole in the lower support 24 such that the channel 34 of the tube 30 passes through the upper support 22 and the lower support 24. In an example embodiment, the upper support 22 and the lower support 24 are connected to the tube 30 at or near a center of the upper support 22 and the lower support 24.

The tube 30, and in particular the channel 34 of the tube 30, is adapted to be lowered over the upper portion 58 of the rod 50 while the rod 50 is inserted into the ground 10. After lowering the tube 30 over the upper portion 58 of the rod 50, the upper portion 58 the rod 50 is positioned in the channel 34 and the lower support 24 rests on the ground 10. The rod 50 and the tube 30 are adapted to be connected to each other to secure the base 20 to the rod 50 and thereby to the ground 10. The upper support 22 is adapted to connect to the bollard 14.

Because the tube 30 is lowered over the upper portion 58 of the rod 50, the inner diameter 36 of the tube 30 is greater than the outer diameter 68 of the rod 50. In an example embodiment that includes the grip 52 integrated into the rod 50, as opposed to the nut 54 that can be unthreaded from the rod 50, the outer diameter of the grip 52 is less than the inner diameter 36 of the tube 30. In an example embodiment, the inner diameter 36 of the tube 30 is between 1 inch and 1⅛ inches, while the outer diameter 68 of the rod 50 is about ⅝ inches. In an example embodiment the outer diameter of the grip 52 is 15/16 inches. In another example embodiment, the outer diameter 68 of the rod 50 is about ⅝ inches, while the inner diameter 36 of the tube 30 about 2 inches.

A length of the tube 30 may be in the range of 12 inches to 36 inches. The length of the tube 30 is less than the length of the upper portion 58 of the rod 50 that is positioned above the ground 10. In an example embodiment, the length of the tube 30 is slightly less than the upper portion 58 of the rod 50 that is positioned above the ground 10. After the tube 30 is lowered over the upper portion 58 of the rod 50 and the lower support 24 rests on the ground 10, the upper end 62 of the rod 50 sticks out of the tube 30 through the upper end 32. The amount the upper end 62 sticks out above the upper end 32 is sufficient to allow the nut 54 and the washer 56 to be coupled to the upper portion 58 of the rod 50. In an example embodiment, the upper end 62 of the rod 50 that sticks out of the upper end 32 of the tube 30 is threaded to permit the nut 54 to be threadably coupled to the upper portion of the rod 50 to couple the rod 50 to the tube 30.

The tube 30 may be formed of any material suitable for connecting to the upper support 22 and the lower support 24. The tube 30 may be of any shape (e.g., round, square, rectangular, triangular). The upper support 22 may be formed of any material and have any shape suitable for connecting to the tube 30 and for connecting to the bollard 14. The lower support 24 may be formed of any material and have any shape suitable for connecting to the tube and for resting on the ground 10.

In an example embodiment, the tube 30 is a 1¼ inch×1¼ inch square metal tube that is between 8 and 16 inches in length. The thickness of the walls of the tube 30 is in the range of 10 gauge to 18 gauge. The upper support 22 is a ½ inch-thick carbon steel or stainless-steel plate between 12 inches and 16 inches in diameter. The lower support 24 is a ⅜-inch-thick carbon steel plate in the shape of a square that is 12 inches on a side. The tube 30 is positioned through a first hole through the center of the upper support 22 and through a second hole through the center of the lower support 24. The upper support 22 and the lower support 24 are welded to the tube around the perimeter of their respective holes to connect the tube 30 to the upper support 22 and the lower support 24. The channel 34 of the tube 30 passes through the upper support 22 and the lower support 24.

In an example embodiment, the height 26 of the base 20 is measured from a lower surface of the lower support 24 to an upper surface of the upper support 22. The upper support 22 is positioned apart from the lower support 24. The lower surface of the upper support 22 is positioned the distance 28 from the upper surface of the lower support 24 thereby forming the space 29 between the upper support 22 and the lower support 24. The height 26 of the base 20 may be about equal to the thickness of the slab of concrete 12 that is poured around the base 20. The height 26 of the base 20 is in the range of 4 inches to 18 inches.

As discussed in greater detail herein, the space 29 between the upper support 22 and the lower support 24 is adapted to be filled with a mass of concrete 12 (e.g., slab, pour) poured around the base 20 thereby securing the base 20 to the mass of concrete 12. The rod 50 and base 20 may be positioned to become part of a slab of concrete 12 when the concrete 12 is poured around the rod 50 and the base 20. As the concrete is poured, the concrete 12 enters into the space 29 to surround the tube 30 and to cover the lower support 24.

The upper surface of the upper support 22 is adapted to be level with the upper surface of the mass of concrete 12 after the concrete 12 is poured around the base 20. In an embodiment, the height 26 of the base 20 is a thickness of a mass of concrete 12 poured around the base 20 whereby the upper surface of the upper support 22 is level with the upper surface of the mass of concrete 12 and exposed from the mass of concrete 12. In other words, when the slab of concrete 12 is poured, the concrete 12 does not cover the upper support 22 of the base 20. The concrete 12 comes up to and is finished level with the upper surface of the upper support 22. After the concrete 12 dries, the upper support 22 is visible and accessible.

Because the upper support 22 is visible and accessible, the upper support 22 is adapted to connect to the bollard 14. In an example embodiment, the bollard 14 is welded to the upper support 22 of the base 20 after the concrete 12 has been poured.

E. Set Screws: Adjusting Base Position and Leveling.

At various stages of installing the anchor system, the position of one or more portions of the anchor system may be adjusted. Adjusting the one or more portions of the anchor system may affect the position of the bollard 14 once attached.

For example, the inner diameter 36 of the tube 30 is greater than an outer diameter 68 of the rod 50, so after the rod 50 is inserted into the ground 10 and the tube 30 lowered over the upper portion 58 of the rod 50, the position of the base relative to the rod may be adjusted. For example, the base 20 may be moved until the rod 50 comes into contact the inner surface of the tube 30, so the position of the base 20 may be moved from side-to-side until movement of the base 20 is stopped by contact of the rod 50 with the inner surface of the tube 30.

For example, in the example embodiment discussed above, the tube 30 is a 1¼ inch×1¼ inch square metal tube, while the rod 50 is a ⅝-inch rod. After the thickness of the sides of the tube 30 are accounted for, the inner dimensions of the tube 30 are about 1"×1", which means that the base 20 may be moved between ⅜ inches (e.g., side-to-side) and about 25/32 inches (e.g., corner-to-corner). In an example embodiment in which the tube 30 is a 2-inch×2-inch square tube and the rod 50 is a ⅝-inch round rod, the base 20 may be moved between 1⅜ inches (e.g., side-to-side) and about 2 inches (e.g., corner-to-corner).

The anchor system of the present disclosure may include one or more set screws 38. The set screws 38 are adapted to threadably connect through a side of the tube 30 to contact the upper portion 58 of the rod 50 positioned in the channel 34. The one or more set screws 38 are adapted to maintain the position of the base 20 relative to the rod 50. So, after the tube 30 has been lowered over the upper portion 58 of the rod 50 until the lower support 24 rests on the ground 10, the position of the base 20 may be adjusted (e.g., moved) relative to the rod 50. Once the position of the base 20 has been adjusted, the set screws 38 may be turned to bring the set screws into contact with the rod 50. Since the set screws 38 are located on each side of the tube 30 and may contact each side of the rod 50, they can be screwed into the tube 30 and into contact with the rod 50 to hold the tube 30 in the adjusted position. Some set screws 38 may need to be turned further into the tube 30 than other set screws 38 to contact the rod 50 to hold the tube 30 in the adjusted position.

The set screws 38 may also be used to hold the upper support 22 of the base 20 level. Once the tube 30 has been lowered over the upper portion 58 of the rod 50 and the lower support 24 brought into contact with the ground 10, the upper support 22 of the base 20 may not be level. If the upper support 22 to the base 20 is not level, the bollard 14 will not be plumb (e.g., vertical) when it is connected to the upper support 22. As discussed above, because the inner diameter 36 of the tube 30 is greater than the outer diameter 68 of the rod 50, the base 20 may be moved (e.g., tilted) relative to the rod 50 which means that the base 20 may be tilted, at least to a certain extent, so that the upper support 22 is level. After the base 20 is positioned so that the upper support 22 is level, the set screws 38 may be screwed (e.g., rotated) into contact with the rod 50 to maintain the upper support 22 level.

The set screws 38 not only hold the position of the base 20 relative to the rod 50 after adjustment, but the one or more set screws 38 further connect the tube 30 to the rod 50. The set screws 38 may be used to connect (e.g., secure) the tube 30 to the rod 50, and thereby the base 20 to the rod 50, in addition to any other connection made between the tube 30 and/or the base 20 and the rod 50. So, the one or more set screws 38 are adapted to threadably connect through a side of the tube 30 to contact the upper portion 58 of the rod 50 positioned in the channel 34. The one or more set screws 38 are adapted to maintain the position the base 20 relative to the rod 50 and to further connect the tube 30 to the rod 50. The set screws 38 connect the tube 30 to the rod 50 to secure the tube 30 to the rod 50 and thereby the base 20 to the ground 10.

F. Prongs.

The base 20 may further include one or more prongs 40. Prongs 40 are adapted to connect (e.g., secure) the base 20 to the mass of concrete 12. The prongs 40 are adapted to connect to the upper support 22, the lower support 24 and/or the tube 30. The prongs 40 are adapted to be surrounded by the concrete 12 as it is poured around the base 20. Preferably, the prong 40 is positioned below the lower surface of the upper support 22 so it does not stick out from the upper surface the concrete 12 after it is poured. Preferably, the prong 40 is positioned above the upper surface of the lower support 24 so it does not interfere with the lower support 24 resting on the ground 10 or leveling the base 20. The prong 40 may be positioned in the space 29 between the upper support 22 and the lower support 24. The prong 40 may extend away from the base 20.

In an example embodiment, the base further includes at least one prong 40 positioned at least partially in the space 29 between the upper support 22 and the lower support 24. The at least one prong 40 is connected to at least one of the upper support 22, the tube 30 and the lower support 24. The prong 40 is adapted to be surrounded by a mass of concrete 12 to secure the base 20 to the mass of concrete 12.

The prong 40 may be formed of any material suitable for connecting to the base 20 and the concrete 12. The prong 40 may have any shape. In an example embodiment, the prong 40 is formed of ½ inch rebar and has a hook-like shape. A first end portion of the prong 40 is connected to a lower surface of the upper support 22. The second end portion, which includes the hook-like shape, is positioned in the space 29 between the upper support 22 and the lower support 24 and extends slightly beyond the outer perimeter of the upper support 22. In an example embodiment, the base 20 includes four prongs 40. In an example embodiment, the prong 40 is welded to the upper support 22. In another example implementation, the prong 40 is connected between the lower surface of the upper support 22 and upper surface of the lower support 24 to strengthen the upper support 22 and the lower support 24.

G. Operation of Preferred Embodiment.

In use, the anchor system is positioned, secured to the ground 10, the concrete 12 is poured around the anchor system, and the bollard 14 is attached to the anchor system.

Installation of the anchor system may begin with determining a thickness of the slab of concrete 12 to be poured. The height 26 of the base 20 of the anchor system selected for installation corresponds to the thickness of the slab of concrete 12. The location for the installed bollard 14 is identified. The rod 50 is inserted into the ground 10 to position the base 20 at the location where the bollard 14 is to be installed. If using an embodiment that does not include the helical member 70, the rod 50 may be inserted into the ground 10 by pounding (e.g., using a hammer) on the upper end 62 of the rod 50 to drive the lower end 64 of the rod 50 into the ground until the lower portion 59 is positioned in the ground. If using an embodiment that includes the helical member 70, the rod may be rotated to bore the helical member 70 and the rod 50 into the ground 10. After the lower portion 59 of the rod 50 is inserted into the ground 10, the upper portion 58 of the rod 50 extends from the ground 10 and is positioned above the ground 10. Inserting the rod 50 into the ground 10 secures the rod 50 to the ground 10.

After the rod 50 has been installed in the ground 10, the base 20 is lifted up above the upper end 62 of the rod 50. The channel 34 of the tube 30 of the base 20 is aligned with the rod 50. The base 20 is lowered so that the upper end 62 of the rod 50 enters the channel 34 of the tube 30. The base 20 is lowered until the lower support 24 of the base 20 rests on the ground 10. While the lower support 24 of the base 20 rests on the ground 10, the upper portion 58 of the rod 50 is positioned in the channel 34. The upper end 62 of the rod 50 extends above the upper end 32 of the tube 30.

After the base 20 is positioned over the rod 50, the position of the base 20 may be adjusted by moving the base 20 relative to the rod 50. The base 20 may also be leveled after positioning the base 20 over the rod 50. After positioning and/or leveling the base 20, the base 20 may be held in position and/or level by the set screws 38.

After positioning and/or leveling the base 20, the base 20 may be coupled to the rod 50. In a first embodiment, the rod 50 is connected to the base 20 using the nut 54 and the washer 56. The hole of the washer 56 is positioned around the rod 50 and lowered until the washer 56 comes into contact with the upper end 32 of the tube 30. The diameter of the washer 56 is greater than a diameter and/or outer perimeter of the upper end 32 of the tube 30. The nut 54 is adapted to threadably connect to the upper end 62 of the rod 50. The nut 54 is rotated in a clockwise direction to move the nut 54 down the threads on the upper end 62 of the rod 50 until the nut 54 comes into contact with the washer 56. The nut 54 is further rotated in the clockwise direction to tighten the nut 54 against the washer 56. Because the lower portion 59 of the rod 50 is secured in the ground 10, tightening the nut 54 against the washer 56 exerts a downward force on the upper end 32 of the tube 30. The downward force secures the base 20 to the rod 50 and to the ground 10. In a second embodiment, the base 20 is connected to the rod 50 using the set screws 38.

In a second embodiment, the anchor system is manufactured with the rod 50 inserted through the tube 30. The rod 50 cannot be removed from the tube 30 because the helical member 70 and the grip 52 are too large to fit through the channel 34. The anchor system is installed by positioning the lower end 64 of the rod 50 in the ground 10 and rotating the rod 50 to insert (e.g., drive) the lower portion 59 into the ground 10. The rod 50 remains positioned in the channel 34 while it is rotated. As the rod 50 is rotated into the ground, the grip 52 draws closer to the upper end 32 of the tube 30. The rod 50 is rotated until the grip 52 is close to the upper end 32. Prior to rotating the rod 50 so that the grip 52 is snug against the upper end 32, the set screws 38 may be used to position and level the base 20. Once the grip 52 is applying a downward force on the upper end 32, the base 20 is secured to the ground 10.

The anchor system is now prepared for installation of the concrete 12. The concrete 12 is poured in the area around the anchor system. The concrete 12 flows into the space 29 of the base 20. The concrete 12 covers an upper surface of the lower support 24. The concrete 12 is finished so that the upper surface of the concrete 12 is level with the upper surface of the upper support 22. As the concrete 12 is poured around the anchor system, the concrete 12 surrounds the tube 30 and the one or more prongs 40. As a concrete 12 dries, the concrete 12 hardens around the tube 30, over the lower support 24 and around the prongs 40. The hardening of the concrete 12 around the base 20 secures the base 20 to the concrete 12. As the concrete 12 is poured around the base 20, the concrete cannot move the base 20 because base 20 is secured to the ground 10 via its connection to the rod 50 and because the rod 50 is secured to the ground 10. Because the rod 50 securely holds the base 20 in position, the concrete 12, as it is being poured, cannot lift (e.g., float) the base upward out of position or move the base 20 horizontally out of position. The base remains in the position where was anchored, which is at or near the desired position of the bollard 14.

After the concrete 12 has hardened, the bollard 14 may be installed. The bollard 14 is installed by connecting the bollard 14 to the upper surface of the upper support 22 of the base 20. The upper surface of the upper support 22 of the base 20 may need to be cleaned prior to connecting the bollard 14 to it.

Preferably, the area of the upper surface of the upper support 22 is greater than the cross-section area of the bollard 14. If the area of the upper surface of the upper support 22 is greater than the cross-section area of the bollard 14, then the position of the bollard 14 may be adjusted prior to connecting the bollard 14 to the upper support 22. In an example embodiment, the upper support 22 is a circle 12 inches in diameter and the bollard 14 is a cylinder having a cross-section diameter of 4 inches. Since the cross-section area of the bollard 14 is significantly less than the area of the upper support 22, the bollard 14 may be positioned anywhere in the area of the upper support 22 prior to welding the bollard 14 to the upper support 22. For example, the bollard 14 may be positioned close to one side of the upper support 22 or the bollard 14 may be moved 12 inches to the other side of the upper support 22. The bollard 14 may be positioned to cover the rod 50, the nut 54 and the washer 56, which limits the amount its position may be adjusted to about 4" in any direction.

After the bollard 14 is positioned relative to the upper support 22 of the base 20, the bollard 14 may be connected to the upper support 22 to secure the bollard 14 to the anchor system. In an example embodiment, the bollard 14 is welded to the upper surface of the upper support 22 of the base 20. The weld 16 secures the bollard 14 to the upper support 22. In another example embodiment, the bollard 14 is connected to the anchor by threadably connecting the bollard 14 to the threads on the upper end 62 of the rod 50. Connecting the bollard 14 to the threads of the upper end 62 of the rod 50 precludes adjusting the position of the bollard 14 with respect to the area of the upper support 22 of the base 20.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. An anchor system for a bollard comprising:

a rod having an upper portion and a lower portion, the rod is adapted to be partially inserted into a ground thereby positioning the upper portion of the rod above the ground and the lower portion of the rod in the ground, wherein the lower portion of the rod is adapted to secure the rod to the ground; and a base having an upper support, a lower support, and a tube having a channel therethrough, wherein the upper support and the lower support are connected to the tube and positioned a distance apart from each other leaving a space therebetween, wherein the tube is adapted to be lowered over the upper portion of the rod while the rod is inserted into the ground whereby the upper portion of the rod is positioned in the channel and the lower support rests on the ground, wherein the rod and the tube are adapted to be connected to each other to secure the base to the rod and thereby to the ground, wherein the upper support is adapted to connect to the bollard;

wherein the base further comprises at least one prong positioned at least partially in the space between the upper support and the lower support, wherein the at least one prong is connected to at least one of the upper support, the tube and the lower support, wherein the prong is adapted to be surrounded by a mass of concrete to secure the base to the mass of concrete.

2. The anchor system of claim 1, further comprising a helical member connected to the rod at or near a lower end of the rod, wherein the helical member is adapted to bore into the ground responsive to rotating the rod to position the lower portion of the rod in the ground.

3. The anchor system of claim 2, further comprising a grip connected to the rod at or near an upper end of the rod, wherein the grip is adapted to facilitate rotating the rod to bore the lower portion of the rod into the ground.

4. The anchor system of claim 3, wherein the grip comprises a nut threadably connected to the rod at or near the upper end of the rod.

5. The anchor system of claim 4, wherein the nut is further adapted to connect the rod to the tube to secure the rod to the base.

6. The anchor system of claim 2, wherein the helical member is further adapted to secure the rod to the ground.

7. The anchor system of claim 1, wherein the space between the upper support and the lower support is adapted to be filled with a mass of concrete poured around the base thereby securing the base to the mass of concrete.

8. The anchor system of claim 1, wherein an upper surface of the upper support is adapted to be level with a mass of concrete after the mass of concrete is poured around the base.

9. The anchor system of claim 1, further comprising one or more set screws, wherein the set screws are adapted to threadably connect through a side of the tube to contact the upper portion of the rod positioned in the channel, wherein the one or more set screws further connect the tube to the rod.

10. The anchor system of claim 1, wherein an inner diameter of the tube is greater than an outer diameter of the rod, wherein after the rod is inserted into the ground and the tube lowered over the upper portion of the rod, a position of the base relative to the rod may be adjusted.

11. An anchor system for a bollard comprising:

a helical member;

a nut;

a rod having an upper portion, a lower portion, an upper end and a lower end, wherein the helical member is connected to the rod at or near the lower end of the rod, wherein the helical member is adapted to bore into a ground responsive to rotating the rod to position the lower portion of the rod in the ground and the upper portion of the rod above the ground, wherein the lower portion of the rod is adapted to secure the rod to the ground; and a base having an upper support, a lower support, and a tube having a channel therethrough, wherein the upper support and the lower support are connected to the tube and positioned a distance apart from each other leaving a space therebetween, wherein the tube is adapted to be lowered over the upper portion of the rod while the rod is inserted into the ground whereby the upper portion of the rod is positioned in the channel and the lower support rests on the ground, wherein the nut is adapted to threadably connect to the rod at or near the upper end of the rod to connect the rod to the tube thereby securing the base to the ground, wherein the upper support is adapted to connect to the bollard;

wherein the base further comprises at least one prong positioned at least partially in the space between the upper support and the lower support, wherein the at least one prong is connected to at least one of the upper support, the tube and the lower support, wherein the prong is adapted to be surrounded by a mass of concrete to secure the base to the mass of concrete.

12. The anchor system of claim 11, further comprising a washer, wherein the washer is adapted to be positioned around the rod between an upper end of the tube and the nut, wherein the nut applies a downward force on the upper end of the tube via the washer to connect the rod to the tube.

13. The anchor system of claim 11, further comprising one or more set screws, wherein the set screws are adapted to threadably connect through a side of the tube to contact the upper portion of the rod positioned in the channel, wherein the one or more set screws further connect the tube to the rod.

14. The anchor system of claim 11, wherein an inner diameter of the tube is greater than an outer diameter of the rod, wherein after the rod is inserted into the ground and the tube lowered over the upper portion of the rod, a position of the base relative to the rod may be adjusted.

15. The anchor system of claim 14, further comprising one or more set screws, wherein the set screws are adapted to threadably connect through a side of the tube to contact the upper portion of the rod positioned in the channel, wherein the one or more set screws are adapted to maintain the position of the base relative to the rod.

16. An anchor system for a bollard comprising:

a helical member;

a rod having an upper portion, a lower portion, an upper end and a lower end, wherein the helical member is connected to the rod at or near the lower end of the rod, wherein the helical member is adapted to bore into a ground responsive to rotating the rod to position the lower portion of the rod in the ground and the upper portion of the rod above the ground, wherein the lower portion of the rod is adapted to secure the rod to the ground; and a base having an upper support, a lower support, and a tube having a channel therethrough, wherein the upper support and the lower support are connected to the tube and positioned a distance apart from each other leaving a space therebetween, wherein the tube is adapted to be lowered over the upper portion of the rod while the rod is inserted into the ground whereby the rod is positioned in the channel and the lower support rests on the ground, wherein the upper support is adapted to connect to the bollard;

a nut adapted to threadably connect to the rod at or near the upper end of the rod;

a washer adapted to be positioned around the rod between an upper end of the tube and the nut, wherein the nut applies a downward force on the upper end of the tube via the washer to connect the rod to the tube;

one or more set screws, wherein the set screws are adapted to threadably connect through a side of the tube to contact the upper portion of the rod positioned in the channel, wherein the one or more set screws are adapted to maintain a position the base relative to the rod and to further connect the tube to the rod; and at least one prong, wherein the at least one prong is connected to at least one of the upper support, the tube and the lower support, wherein no portion of the at least one prong is positioned above an upper surface of the upper support or below a lower surface of the lower support, wherein the prong is adapted to be surrounded by a mass of concrete to secure the base to the mass of concrete.

17. The anchor system of claim 16, wherein a height of the base is a thickness of a mass of concrete poured around the base whereby an upper surface of the upper support is level with an upper surface of the mass of concrete and exposed from the mass of concrete.

* * * * *